US008528788B2

(12) United States Patent
Hummel

(10) Patent No.: US 8,528,788 B2
(45) Date of Patent: Sep. 10, 2013

(54) DISPENSER FOR FLUID TO PASTY MASSES

(75) Inventor: Karlheinz Hummel, Guetenbach (DE)

(73) Assignee: MegaPlast GmbH, Willingen-Schwenningen (DE)

( * ) Notice: Subject to any disclaimer, the term of this patent is extended or adjusted under 35 U.S.C. 154(b) by 683 days.

(21) Appl. No.: 12/451,859

(22) PCT Filed: Jun. 5, 2008

(86) PCT No.: PCT/EP2008/057003

§ 371 (c)(1), (2), (4) Date: Dec. 3, 2009

(87) PCT Pub. No.: WO2008/155232

PCT Pub. Date: Dec. 24, 2008

(65) Prior Publication Data

US 2010/0102090 A1 Apr. 29, 2010

(30) Foreign Application Priority Data

Jun. 18, 2007 (DE) ..... 10 2007 027 889

(51) Int. Cl.
*B67D 3/00* (2006.01)
*B65D 37/00* (2006.01)

(52) U.S. Cl.
USPC ..... 222/153.13; 222/207

(58) Field of Classification Search
USPC ..... 222/207, 153.13, 384, 256
See application file for complete search history.

(56) References Cited

U.S. PATENT DOCUMENTS

| | | | | |
|---|---|---|---|---|
| 3,438,316 | A * | 4/1969 | Rodier | 396/510 |
| 4,732,549 | A | 3/1988 | von Schuckmann | |
| 4,915,601 | A * | 4/1990 | von Schuckmann | 417/472 |
| 5,033,519 | A * | 7/1991 | Puffer et al. | 141/198 |
| 5,664,703 | A * | 9/1997 | Reifenberger et al. | 222/207 |
| 7,025,233 | B2 * | 4/2006 | Masuda | 222/321.9 |
| 7,121,437 | B2 * | 10/2006 | Kasting | 222/482 |
| 7,931,172 | B2 * | 4/2011 | Kuo | 222/153.13 |
| 2004/0149777 | A1 * | 8/2004 | Santagiuliana | 222/190 |
| 2008/0083784 | A1 * | 4/2008 | Foster et al. | 222/153.13 |
| 2010/0116849 | A1 * | 5/2010 | Lautre | 222/153.13 |

FOREIGN PATENT DOCUMENTS

| | | |
|---|---|---|
| EP | 0 318 465 | 5/1989 |
| EP | 1 486 261 | 12/2004 |
| EP | 1 493 490 | 1/2005 |

OTHER PUBLICATIONS

International Search Report.

* cited by examiner

*Primary Examiner* — Paul R Durand
*Assistant Examiner* — Charles P Cheyney
(74) *Attorney, Agent, or Firm* — Collard & Roe, P.C.

(57) ABSTRACT

The invention relates to a dispenser (1) for fluid to paste-like matters (M), having a pump chamber (20) comprising at least one outlet valve (28), a storage chamber (2), and a flow path (2) connecting the storage chamber (2) to the outlet valve (28), wherein a transport safeguard device is provided in order to avoid a discharge of the matter during transport. In order to advantageously configure a dispenser of the type in question with respect to the transport safeguard device, the invention provides that the flow path (W) to the transit safeguard device can be locked.

9 Claims, 6 Drawing Sheets

1
28
x
15
36
12
r
13
35
14
11
5
34
29
33
32
31
9
30
10
19
8
20
16
6
III
III
17
7
W
18
49
II
II
50
51
46
21
23
22
F
47
37
24
44 55 52 45
43
39
48
38
42
40
41
41
3
4
x
M
2

1
28
x
15
36
12
13
35
14
11
5
34
29
33
32
31
9
30
10
19
8
20
16
6
VI
VI
17
7
W
18
49
V
50
51
V
46
21
23
22
F
47
37
24
44
55
52
45
43
39
48
38
42
40
41
41
3
4
x
M
2

DISPENSER FOR FLUID TO PASTY MASSES

CROSS REFERENCE TO RELATED APPLICATIONS

This application is the National Stage of PCT/EP2008/057003 filed on Jun. 5, 2008, which claims priority under 35 U.S.C. §119 of German Application No. 10 2007 027 889.8 filed on Jun. 18, 2007. The international application under PCT article 21(2) was not published in English.

BACKGROUND OF THE INVENTION

1. Field of the Invention

The invention relates to a dispenser for fluid to pasty masses, having a pump chamber that has at least one outlet valve, a storage chamber, and a flow path that connects the storage chamber with the outlet valve, whereby a transport safeguard device is provided to avoid exit of mass during transport.

2. The Prior Art

Dispensers of the type in question are known. In order to prevent exit of the mass being stored in them during transport, such dispensers are provided with a transport safeguard device that prevents movement of the pump head, for example, or blocks the dispensing channel of the pump head, as another example.

SUMMARY OF THE INVENTION

In view of the state of the art described above, a technical problem of the invention is seen in configuring a dispenser of the type in question in particularly advantageous manner with regard to the transport safeguard device.

This problem is solved, first of all and essentially, by means of the object of claim 1, whereby the main approach is that the flow path between the storage chamber and the outlet valve is blocked as a transport safeguard. As a result of this configuration, the pump head, i.e. dispensing head can remain freely mobile, in the manner of activation. However, such activation does not lead to dispensing of mass, at least not of mass contained in the storage chamber. By means of the block in the region of the flow path, no mass can be drawn in from the pump chamber as the result of activation of the pump.

In the following, characteristics are described that preferably have importance in combination with the characteristics of claim 1, but can fundamentally have importance also with only a few characteristics of claim 1, or alone.

For example, in a further development of the object of the invention, it is provided that the flow path is composed, in terms of components, of a part that is fixed relative to the storage chamber and a part that is movable relative to the storage chamber. These parts can be displaced relative to one another, in order to provide the transport safeguard and to cancel out the transport safeguard. The part of the flow path that is movable relative to the storage chamber is accessible from the outside for the user. Thus, in a further development of the object of the invention, the movable part is movable in a horizontal plane, furthermore preferably in a plane directed crosswise to the flow path expanse. Accordingly, the movable part can be displaceable in the manner of a slide, for example, in the horizontal plane, from the part that is fixed relative to the storage chamber, in order to interrupt the flow path. In this regard, an embodiment in which the movable part is rotationally movable, furthermore preferably rotationally movable about a flow path axis, is preferred.

The movable part is furthermore movable so as to be limited with a stop, thus furthermore particularly between two stops that define the transport safeguard, on the one hand, and the cancellation of the transport safeguard, on the other hand, and thus the free operating state of the dispenser. By means of the stops, the user is given an aid for finding the operating states of the dispenser, in each instance. The stops can furthermore also be visible to the user. Alternatively, the outer mantle of the dispenser, particularly the dispenser head and a handle that acts on the movable part of the flow path, can have orientation aids in the form of crosspieces or the like, for example. Thus, for example, crosspieces of the fixed dispenser head part and of the handle that are positioned on top of one another in projection can signal release of the dispenser.

In a preferred embodiment of the object of the invention, it is provided that a hole pattern is formed in the movable part and in the fixed part, in each instance, whereby the hole patterns can be moved into a position in which they are not aligned with one another, in order to achieve the transport safeguard. In the transport safeguard position, the hole patterns lie in coverage with a closed section of the opposite part, thereby interrupting the flow path. Only by the displacement of the movable part into a position in which the hole patterns of the movable part and of the fixed part lie in coverage, the flow path is opened and dispensing of mass from the storage chamber can be achieved.

In the simplest manner, the movable part and the fixed part can have separating bottoms directed towards one another and crosswise to the flow path axis, which are provided with perforations that can be brought into coverage with one another. In this connection, the regions that are adjacent to the perforations in the direction of rotation of the movable part are selected to be so large, in terms of area, that the openings of the fixed part are completely covered after corresponding rotation of the movable part, to interrupt the flow paths. In this regard, a configuration in which the hole pattern of the movable part is formed by one or more vertical grooves, and the hole pattern of the fixed part is formed by one of more bore-like openings is preferred. For this purpose, the fixed part can have a flow path section that surrounds the bore-like openings and accommodates the movable flow path part on its inside wall, particularly the end section provided with the vertical grooves. The vertical grooves can correspondingly be configured as grooves that are open radially to the outside. By means of rotational displacement of the movable part, the vertical grooves can be brought into coverage with the openings of the fixed part, in order to cancel out the transport safeguard, or can be brought into a position in which they do not align with one another, in order to provide the transport safeguard.

In a further development of the object of the invention, a pump chamber inlet valve is provided between pump chamber and storage chamber, whereby furthermore, the movable part forms a valve seat for the inlet valve on the pump chamber side. In this connection, the movable part can preferably be rotated relative to the inlet valve, in order to cancel out or create the transport safeguard. Alternatively, however, the inlet valve can also be disposed so as to rotate with it.

Furthermore, it is proposed that the pump chamber is formed by a pump chamber bellows and that the movable part is movable relative to the pump chamber bellows. The pump chamber bellows can integrally form the inlet valve, as is furthermore preferred, for example furthermore particularly in the region of a bellows bottom that is assigned to the movable part of the flow path.

For activation of the movable part, the latter has a sleeve section on the outside of the dispenser head, in a further development, for activation or re-activation of the transport safeguard. This ring-shaped sleeve section, which is accessible from the outside, is accordingly connected with the movable part so as to rotate with it, and is rotationally movable relative to the dispenser head and furthermore also relative to the storage chamber, so as to be limited by a stop. In this regard, it can furthermore be provided that the sleeve section can also be grasped in a cap-covered position of the dispenser head and rotated accordingly. Thus, the transport safeguard can even be activated if a cover cap is set over the dispenser head.

The stop-limited end rotation positions of the movable part, i.e. of the sleeve section on the outside of the dispenser head, can furthermore also be provided with a catch that can easily be overcome, which catch can only be intentionally cancelled out. Furthermore, in the region of the rotationally movable parts, furthermore, for example, in the region between sleeve section and dispenser head, a tear-off safeguard can be provided, which must be intentionally removed before first-time activation of the dispenser, in order to cancel out the transport safeguard.

BRIEF DESCRIPTION OF THE DRAWINGS

The storage chamber can be part of a separate tube that is connected with the fixed part with a catch connection or screw connection. Such a tube generally consists of a soft plastic with a hard plastic section that faces the fixed part of the dispenser, for fixing it in place with a catch connection or screw connection. Alternatively, the storage chamber can also be part of a shape-stable container.

In the following, the invention will be explained in greater detail using the attached drawing, which shows only an exemplary embodiment. The figures show.

DETAILED DESCRIPTION OF THE PREFERRED EMBODIMENTS

Figure 1:
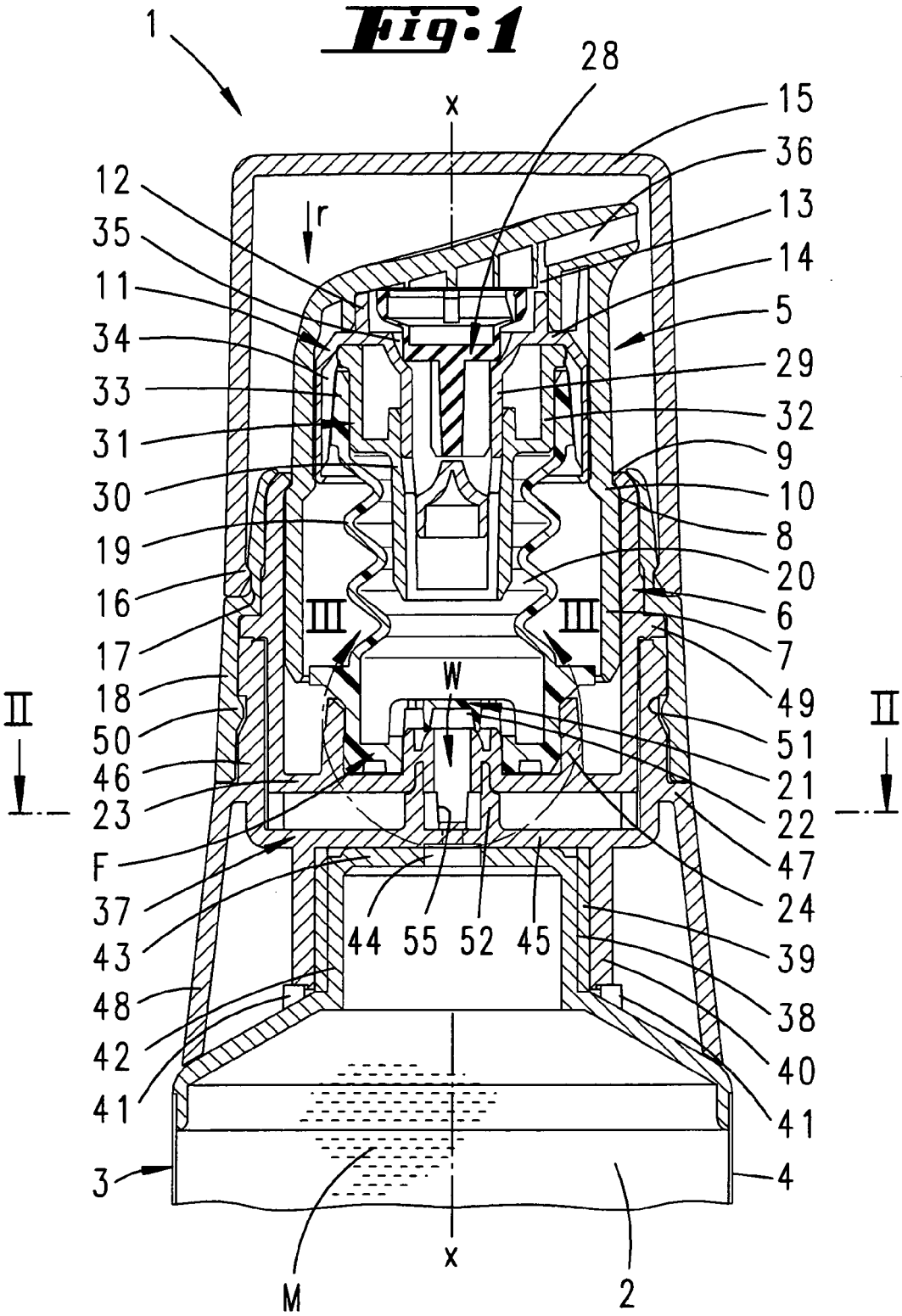
FIG. 1 a longitudinal cross-sectional representation through a dispenser of the type in question, in the cap closure position, and with the transport safeguard activated.
Figure 2:
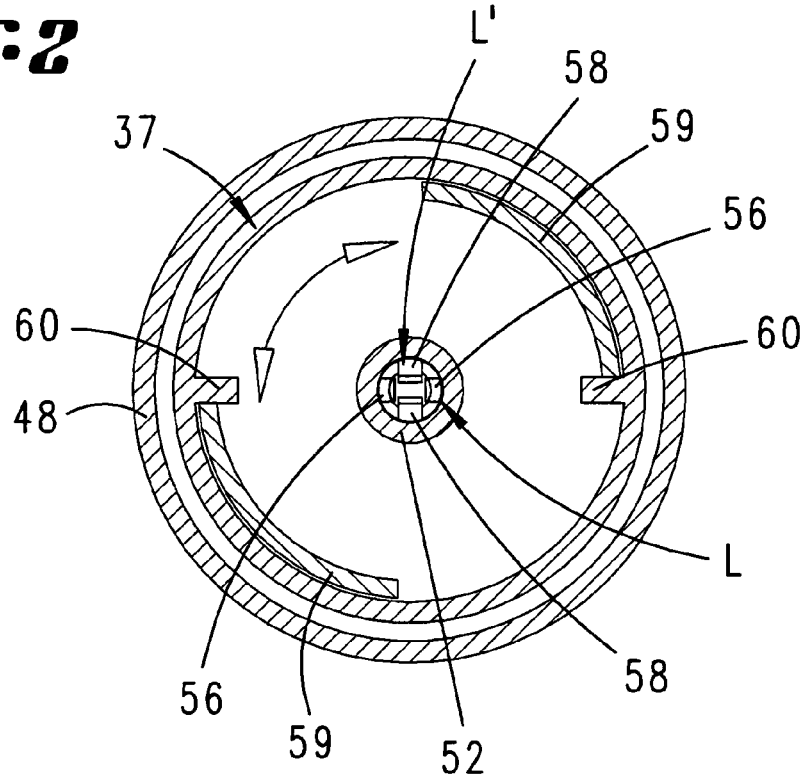
FIG. 2 the section along the line II-II in FIG. 1.
Figure 3:
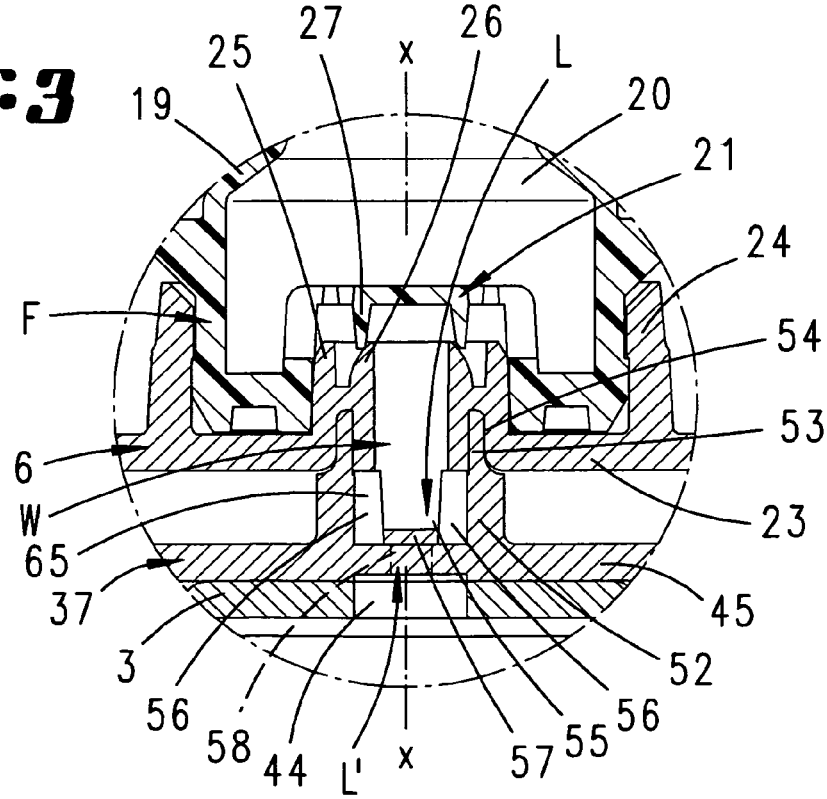
FIG. 3 the enlargement of the region III in FIG. 1.
Figure 4:
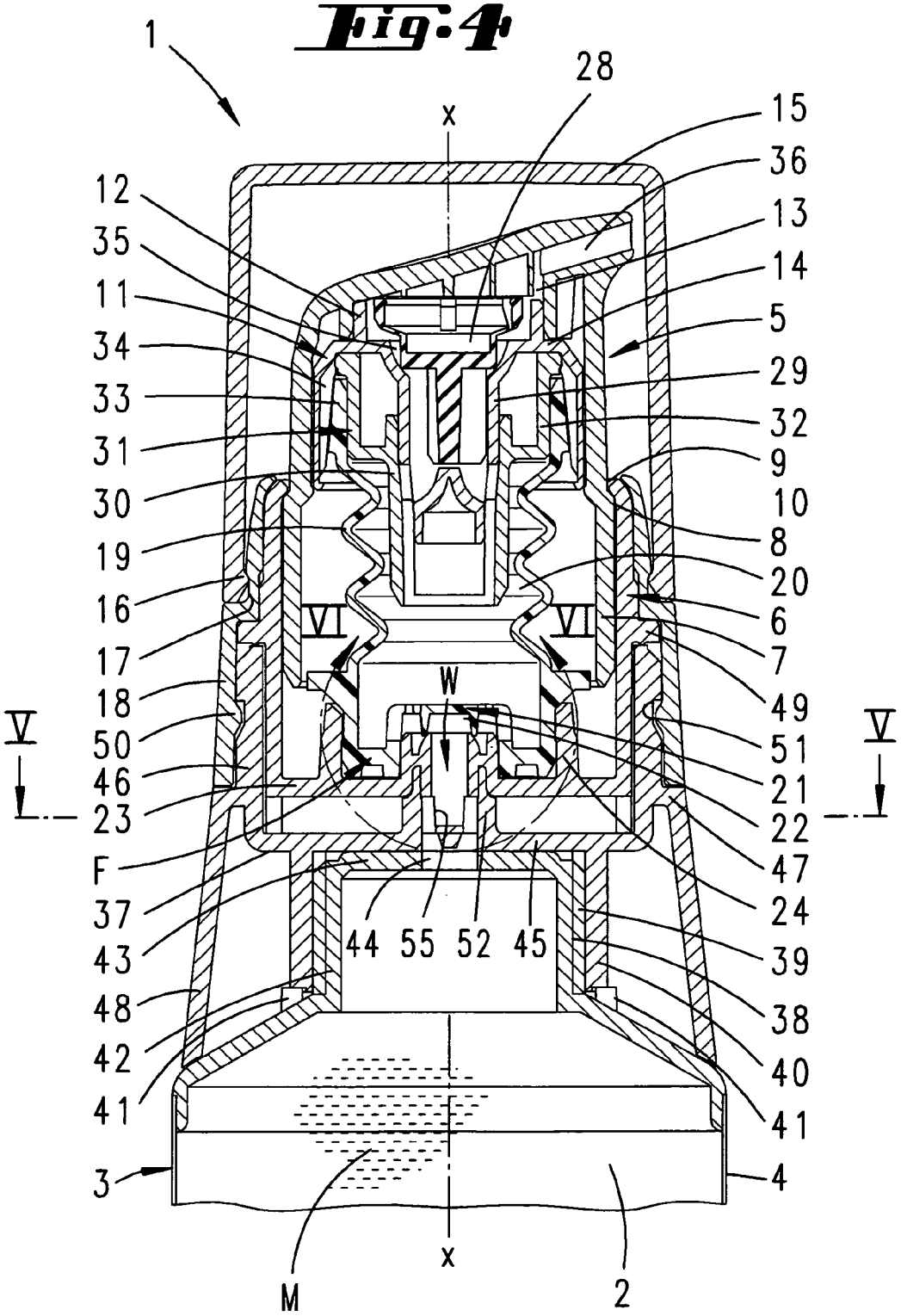
FIG. 4 a representation that corresponds to FIG. 1, but after cancellation of the transport safeguard.
Figure 5:
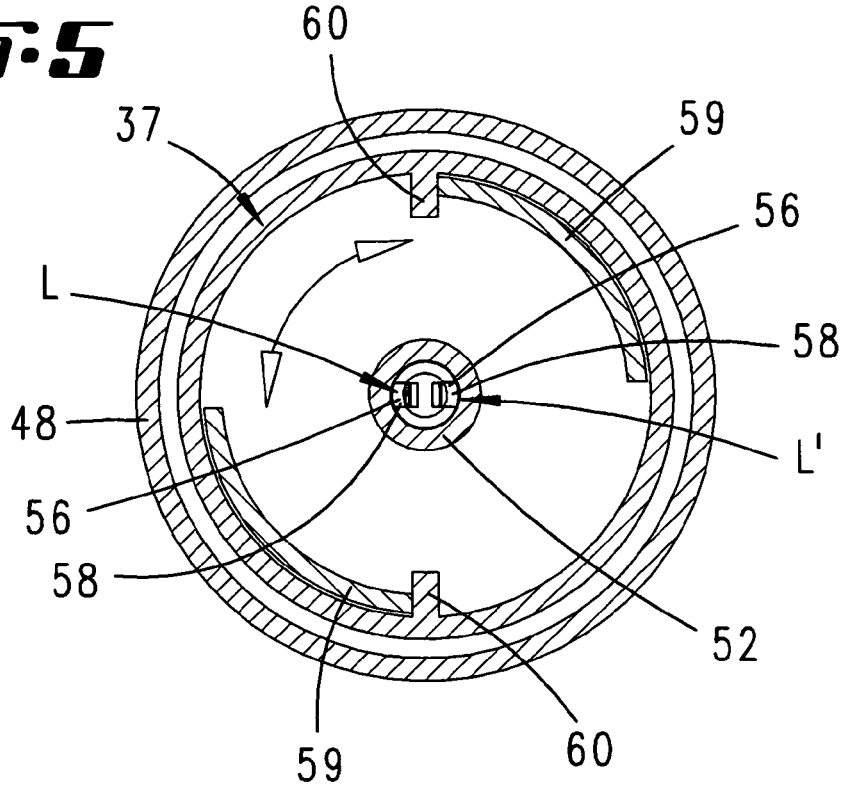
FIG. 5 the section along the line V-V in FIG. 4.
Figure 6:
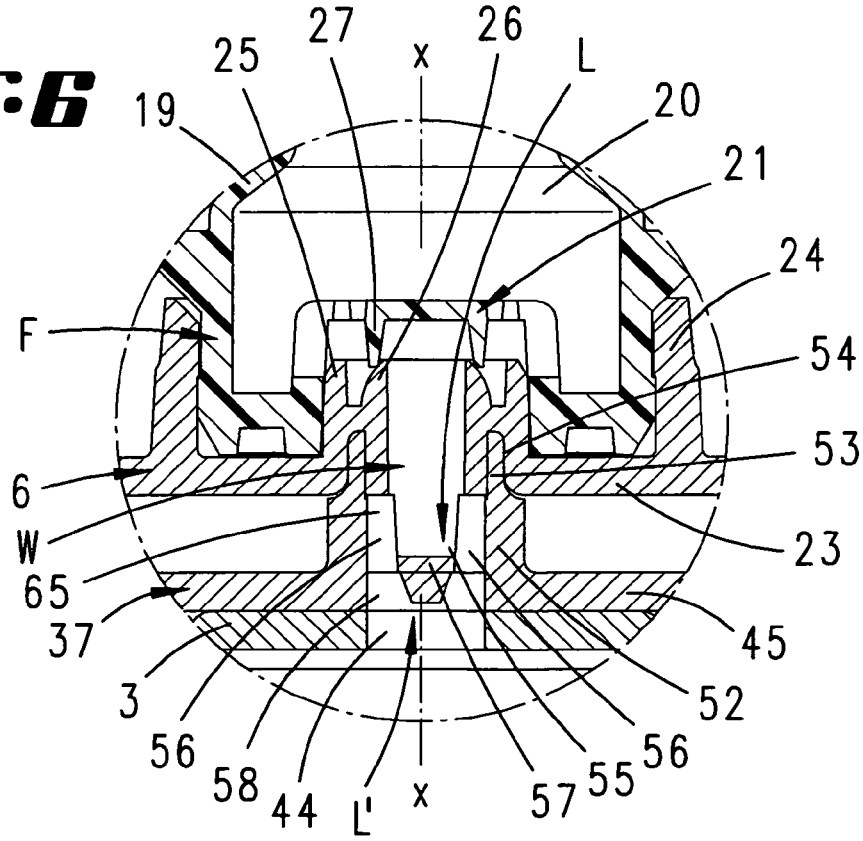
FIG. 6 the enlargement of the region VI in FIG. 4.
Figure 7:
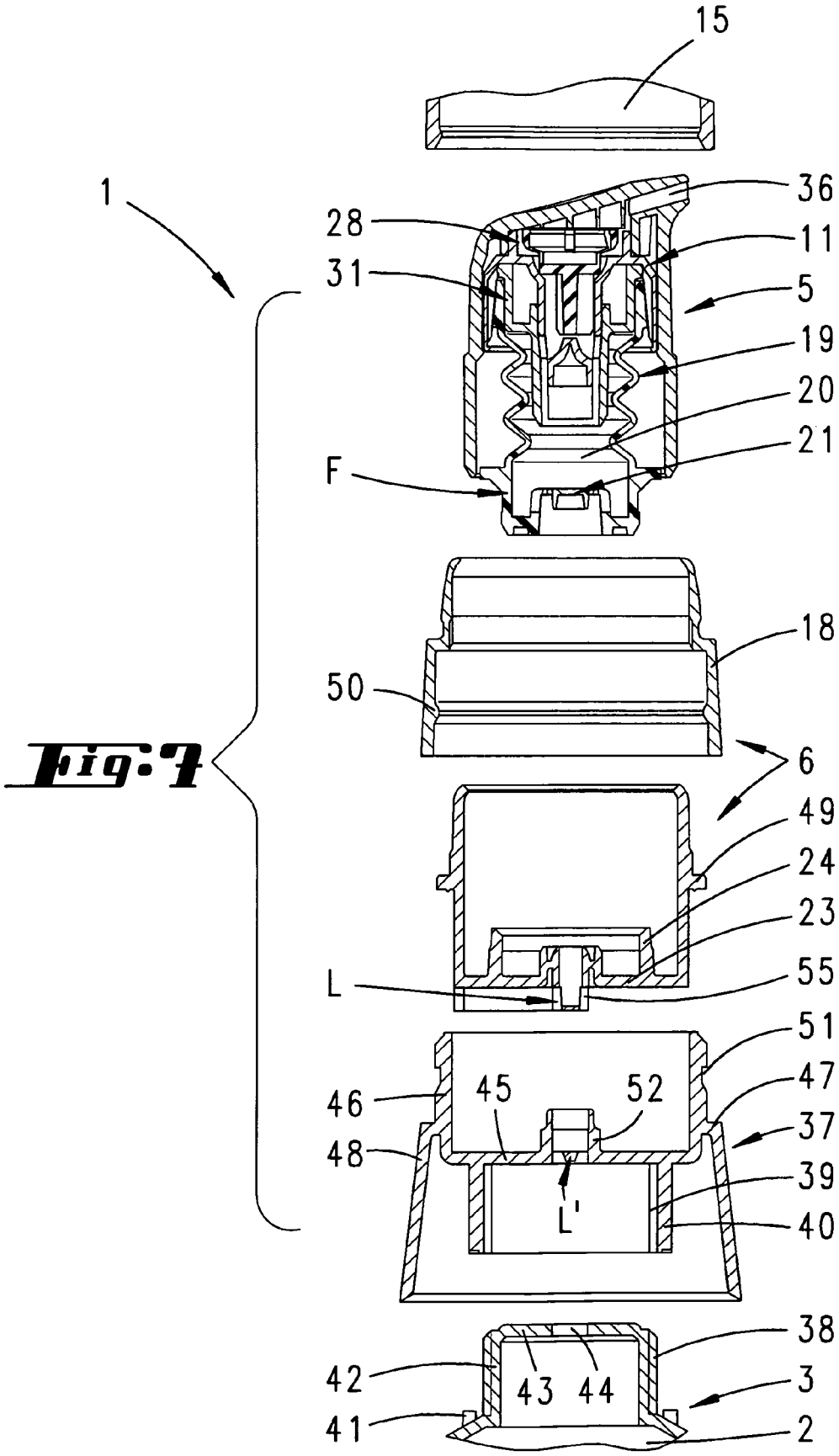
FIG. 7 the dispenser in a longitudinal cross-sectional exploded representation.
Figure 8:
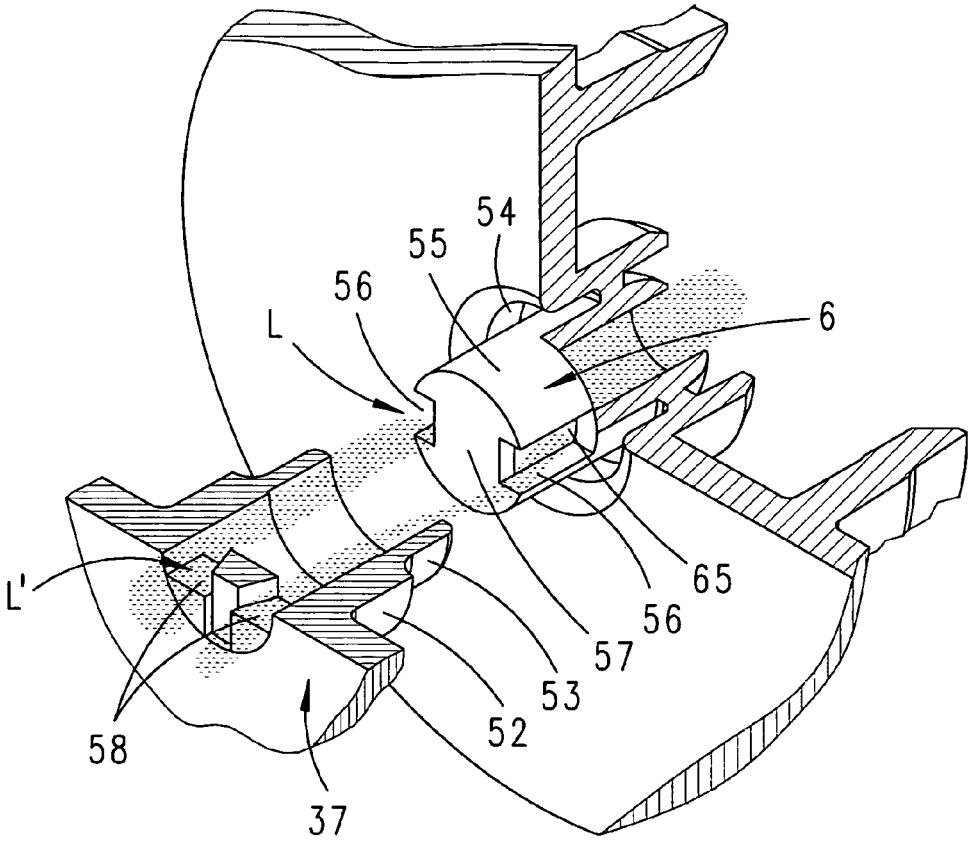
FIG. 8 the parts of the dispenser that form the transport safeguard in a perspective, partly sectional individual representation.

With reference to FIG. 1, first of all, a dispenser 1 is shown and described, which is provided for dispensing a fluid to pasty mass M, for example a cream or the like.

The dispenser 1, which is shaped approximately in cylinder shape and has a circular cross-section, possesses a storage container 3 that forms a storage chamber 2, which container is configured as a separate tube 4 in the exemplary embodiment shown.

At the same time, the dispenser 1 has a dispenser head 5 configured as a pump head, which in turn is disposed on the dispenser 1 in telescoping manner, for removal of the mass M to be dispensed.

Thus, it is provided that the dispenser head 5 interacts in telescoping manner with a part 6 that is immovable in the direction of expanse of the dispenser axis x. For this purpose, it is furthermore provided that the dispenser head 5, in its lower region, has a wall section 7 that is enlarged in diameter in the circumference direction and configured in step shape in cross-section, which section in turn is guided by the inside wall of a cavity 8 of the part 6 during pump activation of the dispenser head 5. In order to axially secure the dispenser head 5 in the cavity 8 of the part 6, it is provided that the opening edge 9 of the cavity 8 becomes narrower inward toward the cavity, and interacts with a step 10 of the wall section 7, to form a block.

As is furthermore evident, the dispenser head 5 surrounds a transition part 11 that is firmly positioned in the dispenser head 5 and disposed centered around the dispenser axis x, whereby the attachment between the dispenser head 5 and the transition part 11 is undertaken by means of a catch connection, not shown in any detail. The neck 12 of the transition part 11, which neck is configured in step shape, projects into an accommodation opening 13 disposed in the upper region of the dispenser head 5 and configured in circular shape, which opening in turn interacts with the outer wall of the neck 12 with its inner wall, forming a seal. The edge face surface of the accommodation opening 13 supports itself in planar manner on a correspondingly adapted step 14, against which the neck 12 is rooted. Because of this and because of the catch connection, the transition part 11 is captured within the dispenser head 5, about the dispenser axis x, so that accordingly, the transition part 11 follows and accompanies the axial displacement of the dispenser head 5 that results from pump activation of the dispenser head 5.

In non-use position, the dispenser head 5 is covered by a protective cap 15 in accordance with the representation in FIG. 1. This cap is provided on its foot side, i.e. in the region of its opening edge, with a catch ring 16 that runs circumferentially on the inside, for catch interaction with a corresponding ring-shaped catch accommodation 17 of the dispenser part 6, i.e. of a sleeve section 18 fixed in place on the outer wall of the part 6, so as to rotate with it.

Furthermore, a pump chamber bellows 19 that interacts with the transition part 11 and is positioned centered about the dispenser axis x is disposed within the dispenser head 5. This bellows forms a pump chamber 20 in the interior. When the dispenser head 5 is activated in the pump direction r (after removal of the protective cap 15), the pump chamber bellows 19 is compressed in usual manner, storing energy, and thus also makes the required reset force for the dispenser head 5 available.

In vertical section, the pump chamber bellows 19 is configured to run in a zigzag, but as a horizontal cross-section would show, it is structured to be fundamentally circular. This is preferably a plastic injection-molded part made of a corresponding soft elastic plastic. Within the pump chamber 20, on the foot side, the pump chamber bellows 19 possesses an integral inlet valve 21, disposed in centered manner, whose axially subordinate interaction part, which forms an inlet opening 22, is formed by a bottom 23 of the dispenser part 6.

In a further detail, the dispenser part 6 forms a support base 24 that projects from the bottom 23, in which the foot region F of the pump chamber bellows 19 sits on the underside, specifically in interaction with the inner wall of the support base 24, which is configured in circular shape. In this region, the pump chamber bellows 19 is not configured in the manner of a bellows, but rather with a solid wall that has a reinforced cross-section in the overlap region with the support base 24.

Surrounded by the support base 24, the pump chamber bellows 19, i.e. its foot region F, sits on the floor 23. In this connection, both the foot region F and the inlet valve 21 of the pump chamber bellows 19 are disposed concentrically about the inlet opening 22 of the bottom 23. On the outlet side, the inlet opening 22 makes a transition into two concentric rings 25 and 26. The outer surface of the inner ring 26 interacts with a concentric lip 27 of the inlet valve 21, forming a seal.

At the top in the dispenser head 5, there is an outlet valve 28 disposed concentrically about the dispenser axis x, which is configured as a soft elastic plastic part. The outlet valve 28 sits in a channel 29 of the transition part 11, which channel is configured in funnel shape and runs axially. By way of the cylindrical outer wall of the channel 29, the transition part 11 sits firmly in a holder section 30 of a second adapter part 31, which section is concentrically disposed and configured to be circular. The adapter part 31 interacts with the transition part 11 by way of a collar 32 that surrounds the holder section 30 and is enlarged in diameter, in such a manner that the pump chamber bellows 19 is fixed in place between the collar 32 and a corresponding support surface of the transition part 11, by way of an upper collar 33, by means of being clamped in, for which purpose clamping crosspieces 34 are furthermore provided on the inside wall of a transition part section that concentrically surrounds the collar 32 of the adapter part 31 and the collar 33 of the pump chamber bellows 19.

The outlet valve 28 interacts with an opening section 35 of the channel 29, which section widens in funnel shape, forming a seal.

The outlet opening formed in this way stands in connection with a dispensing channel 36 that is oriented crosswise to the dispenser axis x.

The connection of the dispenser head 5 with the storage container 3 takes place by way of another dispenser part 37, by means of a screw connection provided between the storage container 3 and the dispenser part 37, in the exemplary embodiment shown in FIG. 1 to 6. For this purpose, the neck of the storage container 3 is provided with an outside thread 38. This interacts with an inside thread 39 of a section of the dispenser part 37 that is placed in pot-like manner over the neck of the storage container 3. The pot section is open toward the bottom, whereby in the screwed-on position according to FIG. 1, the opening edge of the pot section 40 acts against a twist-open safeguard 41 that is provided on the container side.

The neck 42 of the storage container 3 is provided with a closure cover 43 that is oriented crosswise to the dispenser axis x, which cover has a passage opening 44 centrally, coaxially to the axis x. This cover 43 is covered by a bottom section 45 of the second dispenser part 37, which lies on it in planar manner, which bottom 45 makes a transition, outside the pot section 40, into a collar 46 that surrounds the first dispenser part 6, guiding it. Approximately in the transition region of the bottom 45 into the collar 46, a step 47 is formed on, radially on the outside, followed by a cuff section 48 that surrounds the pot section 40 and widens in funnel shape toward the bottom.

The first dispenser part 6 sits on the free face surface of the collar 46, which faces upward, with a radial collar 49, and can be rotated relative to the fixed second dispenser part 37, about the dispenser axis x. For handling the rotation, the first dispenser part 6 is provided with the sleeve section 18 on the outside of the dispenser head. This section is connected with the part 6 so as to rotate with it, in the region of the section of the part 6 that extends above the radial collar 49, by way of a gear mechanism, not shown, and extends, surrounding the radial collar 49, in mantle-like manner, surrounding the collar 46 of the fixed dispenser part 37, all the way to the step 47 on the dispenser side. By way of a circumferential bead 50 provided on the inside of the wall, which bead engages into a correspondingly positioned ring accommodation 51 of the collar 46, a pull-off safeguard is achieved, while allowing free rotational mobility of the movable part 6 relative to the dispenser part 37.

The step-like section of the sleeve section 18 that covers the step 47 represents the support surface for the related edge of the protective cap 15.

The bottom 23 of the first dispenser part 6 is spaced apart from the bottom 45 of the fixed dispenser part 37. For this purpose, a hollow journal 52 is provided facing the bottom 23 of the first movable part 6, on the bottom 45 of the second, fixed part 37, which journal has an inside diameter that is adapted to the diameter of the passage opening 44 of the storage container 3. Toward the top, the hollow journal 52 is reduced in outside diameter, while the inside diameter remains the same. This reduced section 53 engages into a correspondingly positioned ring groove 54 of the bottom 23. The interior of the hollow journal 52 as well as the inlet opening 22 configured ahead of the inlet valve 21 in the bottom 23, in the flow direction of the mass M, form a common flow path W oriented coaxial to the dispenser axis x.

In the movable part 6, in concrete terms in a continuation 55 that projects downward into the hollow journal 52 on the bottom side, as well as on the fixed part 37, in concrete terms in the region of the region of the bottom 45 assigned to the hollow journal 52, hole patterns L, L' are provided, in order to achieve a transport safeguard. Particularly in the representation in FIG. 6, the hole patterns L and L' can be clearly seen, in each instance.

Thus, the hole pattern L of the movable part 6 is formed by vertical grooves 56 formed on the continuation 55, on the outside wall. These grooves extend over an axial height that approximately corresponds to the distance between the bottoms 23 and 45 of the two parts 37 relative to one another. The two vertical grooves 56 lie diametrically opposite and are configured to be open radially toward the outside and on the bottom side, i.e. in the region of the free end of the continuation 55. Above the continuation bottom 57, the vertical grooves 56 stand in connection with the channel-like flow path W, i.e. with the inlet opening 22, by way of crosswise openings 65.

The hole pattern L' of the fixed part 37 is formed by two diametrically opposite, axially oriented bore-like openings 58, in the bottom region surrounded by the hollow journal 52.

By means of rotational displacement of the parts 6 and 37 relative to one another, about the dispenser axis x, the hole patterns L and L', i.e. the vertical grooves 56 and openings 58, can be brought into coverage, so that the flow path W is opened to allow the mass M to pass through. This mass M enters into the pump chamber 20, when the dispenser head is activated, through the bores 58 of the fixed part 37 and the vertical grooves 56 that are oriented with them, through the inlet opening 22, when the inlet valve 21 is opened.

In order to achieve a transport safeguard, the rotationally movable part 6 is rotated by way of the sleeve section 18 connected so as to rotate with it, for example further by 90°, so that afterwards, the hole patterns L and L' no longer align with one another. Instead, the bores 58 of the fixed part 37 are covered by the continuation bottom 57 of the rotated continuation 55, forming a seal. The flow path W is accordingly interrupted and blocked.

Rotation of the movable part 6 by way of the sleeve section 18 is possible even when the protective cap 15 is set on, whereby furthermore, rotation of the movable part 6 is limited by a stop. For this purpose, this part 6 has slats 59 formed onto the underside, on the bottom 23, that project into the free space between bottom 23 and bottom 45 of the fixed part 37, are circular in cross-section and extend over 90°, which slats act, on the inside of the wall, lying on the collar 46 of the fixed part 37, against stop shoulders 60 that project radially inward from this collar 46 (see FIGS. 2 and 4).

Figure 9:
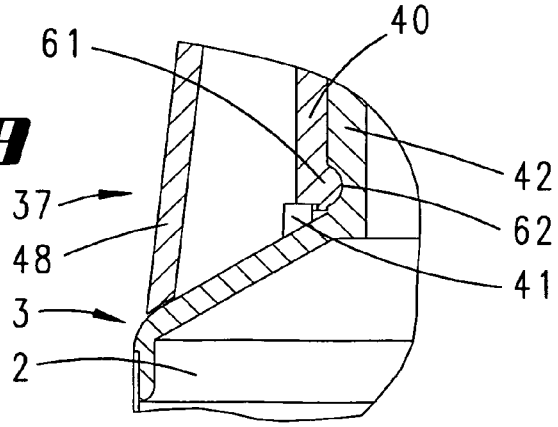
FIG. 9 an alternative embodiment of the connection region of the dispenser to a container.

FIG. 9 shows an alternative embodiment of the fixation of the dispenser 1 on the storage container 3. Here, the connection takes place by way of a catch seat, for which purpose the pot section 40 of the fixed part 37 has a circumferential catch projection 61 that projects radially inward, in the region of its free end, which projection engages into a correspondingly positioned ring groove 62 of the container neck 42.

All the characteristics disclosed are essential to the invention (in and of themselves). The disclosure content of the related/attached priority documents (copy of the prior application) is also incorporated into the disclosure of this application, with its full content, also for the purpose of incorporating characteristics of these documents into claims of the present application.

The invention claimed is:

1. Dispenser (1) for fluid to pasty masses (M), having a pump chamber (20) that has at least one outlet valve (28), a storage chamber (2), and a flow path (W) that connects the storage chamber (2) with the outlet valve (28), whereby in order to avoid exit of mass during transport, a transport safeguard is provided, wherein the flow path (W) is blocked with closure means as the transport safeguard, wherein further the flow path (W) is provided for by two components, of which one component is fixed relative to the storage chamber (2) and another component is moveable relative to the storage chamber (2) and wherein a pump chamber inlet valve (21) is provided and wherein the movable component (6) forms a valve seat for the inlet valve (21) on the pump chamber side; and wherein a hole pattern (L, L') is configured in the movable component (6) and in the fixed component (37), in each instance, whereby the hole patterns (L, L') must be moved into a position in which they do not align with one another in order to achieve the transport safeguard.

2. Dispenser according to claim 1, wherein the movable component (6) is moveable in a horizontal plane.

3. Dispenser according to claim 1, wherein the movable component (6) is moveable to rotate.

4. Dispenser according to claim 1, wherein the movable component (6) is moveable in a manner limited by stops.

5. Dispenser according to claim 1, wherein the hole pattern (L) of the movable component (6) is formed by one or more vertical grooves (56) and wherein the hole pattern (L') of the fixed component (37) is formed by one or more bore-like openings (58).

6. Dispenser according to claim 1, wherein the pump chamber (20) is formed by a pump chamber bellows (19) and wherein the movable component (6) is moveable relative to the pump chamber bellows (19).

7. Dispenser according to claim 6, wherein the pump chamber bellows (19) integrally forms the inlet valve (21).

8. Dispenser according to claim 1, wherein the movable component has a sleeve section (18) on the outside of the dispenser head, for activation or re-activation of the transport safeguard.

9. Dispenser according to claim 1, wherein the storage chamber (2) is part of a separate tube (4) that is connected with the fixed component (37) by means of a catch connection or screw connection.

* * * * *